US005311674A

United States Patent [19]

Santiyanont et al.

[11] Patent Number: 5,311,674

[45] Date of Patent: May 17, 1994

[54] ENERGY RETURN SYSTEM IN AN ATHLETIC SHOE

[76] Inventors: Kiartchai Santiyanont, all of 27 Pramuan Road, Silom, Bangrak, Bangkok, Thailand; Narong Chokwatana; Krisada Suchiva, all of Bangkok, Thailand

[21] Appl. No.: 103,607

[22] Filed: Aug. 6, 1993

Related U.S. Application Data

[63] Continuation of Ser. No. 862,910, Apr. 3, 1992, abandoned.

[30] Foreign Application Priority Data

Apr. 22, 1991 [GB] United Kingdom ..... 9108548

[51] Int. Cl.[5] ..... A43B 13/18

[52] U.S. Cl. ..... 36/28; 36/30 R; 36/35 R

[58] Field of Search ..... 36/28, 35 R, 37, 29, 36/38, 27, 35 B

[56] References Cited

U.S. PATENT DOCUMENTS

| | | | |
|---|---|---|---|
| Re. 13,150 | 9/1910 | Byrne | 36/37 |
| 922,094 | 5/1909 | Cummings | 36/37 |
| 1,098,241 | 5/1914 | Forray | 36/38 |
| 1,128,220 | 2/1915 | Bullard | 36/37 |
| 1,167,885 | 1/1916 | Carll | 36/37 X |
| 3,834,046 | 9/1974 | Fowler | 36/28 |
| 4,187,620 | 2/1980 | Selner . | |
| 4,262,433 | 4/1981 | Hagg et al. | 36/25 |
| 4,391,048 | 7/1983 | Lutz | 36/35 R X |
| 4,506,460 | 3/1985 | Rudy | 36/28 |
| 4,535,553 | 8/1985 | Derderian et al. | 36/28 |
| 4,733,483 | 3/1988 | Lin | 36/28 |
| 4,798,009 | 1/1989 | Colonel et al. . | |
| 4,815,221 | 3/1989 | Diaz | 36/27 |
| 4,817,304 | 4/1989 | Parker et al. | 36/114 |
| 4,843,741 | 7/1989 | Yung-Mao | 36/28 X |
| 4,845,863 | 7/1989 | Yung-Mao | 36/114 |
| 4,999,931 | 3/1991 | Vermeulen | 36/29 |
| 5,086,574 | 2/1992 | Bacchiocchi | 36/35 R |
| 5,092,060 | 3/1992 | Frachey et al. | 36/28 X |

FOREIGN PATENT DOCUMENTS

| | | | |
|---|---|---|---|
| 0932955 | 4/1948 | France | 36/28 |
| WO90/12518 | 11/1990 | PCT Int'l Appl. . | |
| 9111928 | 8/1991 | World Int. Prop. O. | 36/28 |

*Primary Examiner*—Paul T. Sewell
*Assistant Examiner*—Ted Kavanaugh
*Attorney, Agent, or Firm*—Townsend and Townsend Khourie and Crew

[57] ABSTRACT

An energy return system to be positioned in the midsole region of an athletic shoe comprises a top member made of resilient material and including a base having a plurality of integrally formed, closely spaced, downwardly depending and downwardly tapering elements, a bottom member made of resilient material and including a base having a plurality of corresponding integrally formed, closely spaced, upwardly extending and upwardly tapering elements, and sandwiched between the tips of the two set of elements a thin stiff intermediate sheet, the tips of the two pluralities of elements being aligned face to face with the stiff sheet positioned between them.

16 Claims, 2 Drawing Sheets

ENERGY RETURN SYSTEM IN AN ATHLETIC SHOE

This is a continuation of application Ser. No. 07/862,910, filed Apr. 3, 1992, now abandoned.

BACKGROUND OF THE INVENTION

This invention relates to footwear in general and in particular to shoes to be used for sporting activities such as running, jogging, walking or playing games. For convenience such shoes will be hereinafter called "athletic shoes".

The design of athletic shoes has improved dramatically in recent years. Originally such shoes had little or no cushioning in the soles and runners and other sportsmen began to find serious problems in joints and bones as a result of the pounding which occurs during the sporting activity. In recent times various degrees of cushioning have been built into athletic shoes to absorb shocks so as to lessen the negative skeletal impact and improve the perceived comfort to the user. This has helped to reduce the shock forces in the body. However, mere cushioning is not enough. Thus, if of one simply has a shoe which only absorbs all of such forces, this means that a great deal of energy is lost during each stride and so the athlete will tire more quickly.

Therefore it is desirable to design the soles of athletic shoes so that not only are the negative shock forces absorbed, but also the positive energy absorbed must as far as possible be returned to the athlete to enhance his performance and stamina. This is often termed "energy return".

The invention therefore is concerned with this aspect of athletic shoes and it is an object of the invention to provide a high energy return in athletic shoes whilst at the same time providing excellent cushioning.

SUMMARY OF THE INVENTION

According to the invention there is provided an athletic shoe in which the midsole region includes at least one energy return system comprising a top member made of resilient material and including a base having a plurality of integrally formed, closely spaced, downwardly depending and downwardly tapering elements, a bottom member made of resilient material and including a base having a plurality of corresponding integrally formed, closely spaced, upwardly extending and upwardly tapering elements, and sandwiched between the tips of the two set of elements a thin stiff intermediate sheet, the tips of the two pluralities of elements being aligned face to face with the stiff sheet positioned between them.

The above arrangement acts both as a cushioning system and a very responsive (quick recovery) energy return system. Thus it returns positive energy to the athlete faster and in significantly larger amounts than prior midsole systems made from polyurethane or ethylene vinyl acetate.

Energy return is the activity which occurs after the maximum compression of the system is reached. Thus the system must first absorb or cushion shock forces and then the rebound phase immediately begins as the weight or load of the impact is lifted and that weight or load is propelled off the midsole by the energy return system. Thus to a performance athlete it is highly desirable that as much of the positive energy force which have been absorbed be returned as quickly as possible to the athlete so as to enhance his performance by causing him less physical fatigue through energy loss and generally aid in improving his performance and endurance.

It is preferred that the energy return system according to the invention be provided in the midsole heel region of the shoe so as to cushion and generally return the positive absorbed forces to the athlete's foot in that area.

Preferably the top and bottom members are made of natural or synthetic rubbers such as butadiene rubbers, natural rubbers or combinations thereof; most desirably at least one member is made from a butadiene rubber. Such members have better strength and resiliency and resist permanent compression set and molecular degradation better than the polyurethane or ethylene vinyl acetate materials which are conventionally used as cushioning systems in the midsole heel region of athletic shoes.

Desirably the material of the top member has a Shore A hardness of from 30 to 80, and more preferably from 45 to 60. It is also desirable that the material of the bottom member have a Shore A hardness of from 30 to 70, and more preferably from 35 to 40.

The precise choice of hardness for the top and bottom members will depend upon the particular activity for which the shoe is designed and on the weight of the user. Thus the heavier the intended user the harder the system should be and conversely the lighter the intended user the softer the system should be.

The piece of stiff intermediate material sandwiched between the tips of the two pluralities of elements can, for example, be a nylon, or polypropylene sheet. It needs to be stiff or rigid enough to resist excessive flexing so as to ensure that the forces are applied tip to tip between the two corresponding elements. Desirably the thickness of this sheet should be from 0.3 to 0.7 mm, and more preferably about 0.5 mm.

Also the cohesive friction forces between the tips and the material of the intermediate sheet needs to be high, so as to prevent slippage and maintain the tips so that they are aligned and so that the compression forces exerted on the system passes downwardly through the aligned tapering elements.

It is preferable that each of the tapering elements be of substantially hemispherical shape. This has the advantage that initially the areas of contact between the tips and the intermediate member are small but as the force or load increases then the areas will increase relatively rapidly as the elements become compressed and so the resistance to compression also increases rapidly with compression. This rate of increase in resistance to compression can be altered as required by choice of the number, cross sectional shape and dimension, height, hardness and arrangement of the tapering elements to suit the degree of cushioning and energy return required and to suit the weight of the intended user.

Desirably the energy return system according to the invention also includes alignment elements at the corners or at opposed positions of the top and bottom members for joining one to the other and then the overall system can be permanently fixed in a cavity in the midsole of the shoe.

The energy return system used in an athletic shoe according to the invention can be used on its own or employed together with other cushioning and/or shock absorbing systems within the same shoe. As an example the system used according to invention can be used with an overlaying sheet of a material having a low hardness, an almost zero compression set and a low percentage rebound resilience. The resulting combined system has improved shock absorption and energy return.

DESCRIPTION OF THE PREFERRED EMBODIMENT

Figure 1:
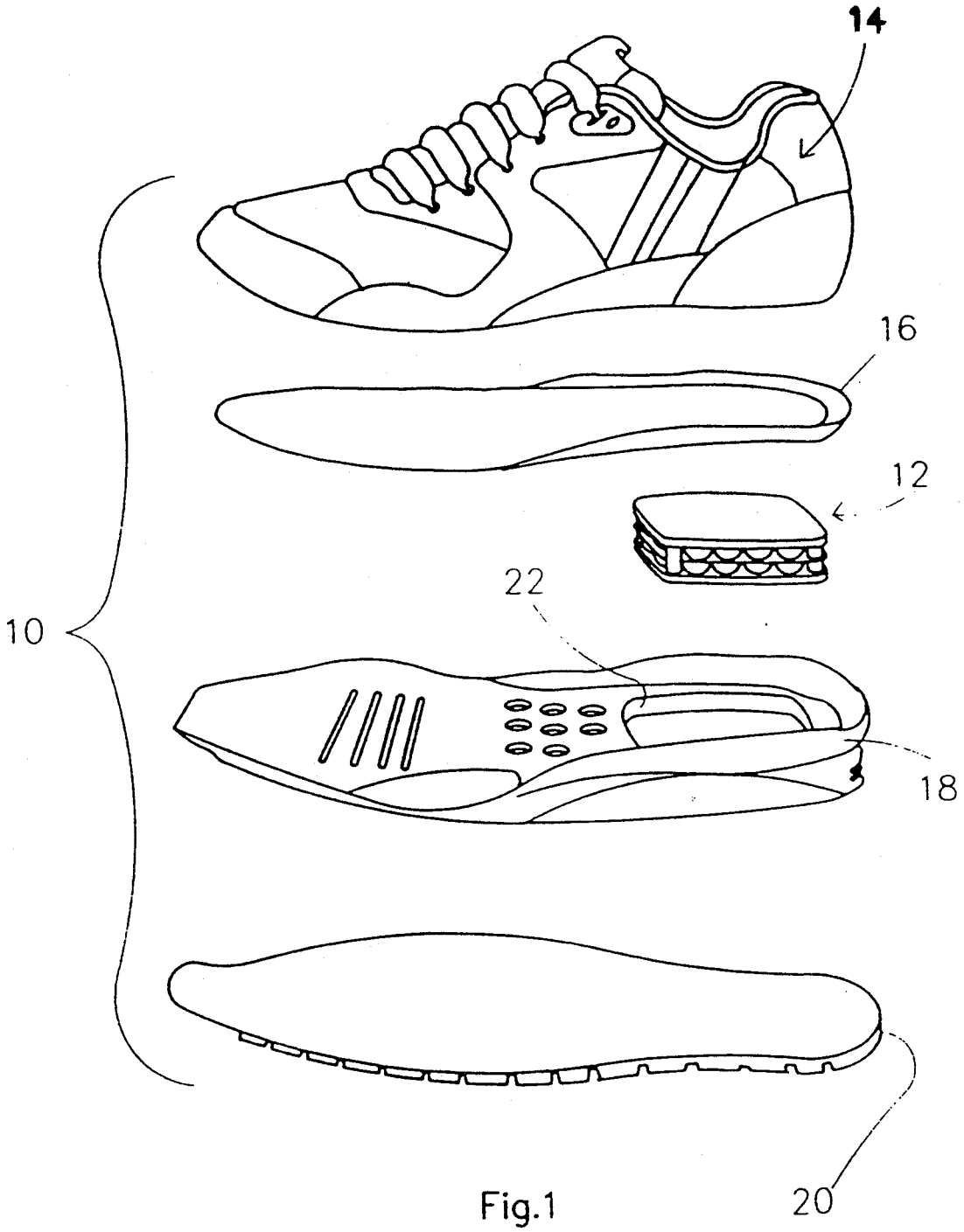
FIG. 1 is an exploded view showing the component parts of an athletic shoe according to the invention.

The athletic shoe 10 according to the invention is shown in FIG. 1 in an exploded form with all its components separated. In general terms the shoe is of entirely conventional construction apart from the energy return system 12 which is incorporated in the heel area of the midsole in the resulting shoe.

The shoe 10 comprises an upper 14, an insole 16, a midsole 18, and an outsole or tread 20. All of these component parts are entirely conventional and their construction is conventional in the art of athletic shoe making.

In the midsole 18 in the heel area is a cavity 22 and it is in this cavity 22 that the energy return system 12 is positioned. The top of the energy return system 12 lays flush with the top inside surface of the midsole.

Figure 2:
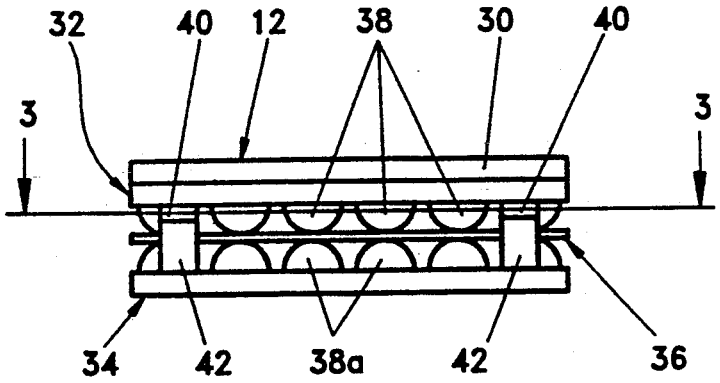
FIG. 2 is a side view of the energy return system in the shoe shown in FIG. 1.
Figure 3:
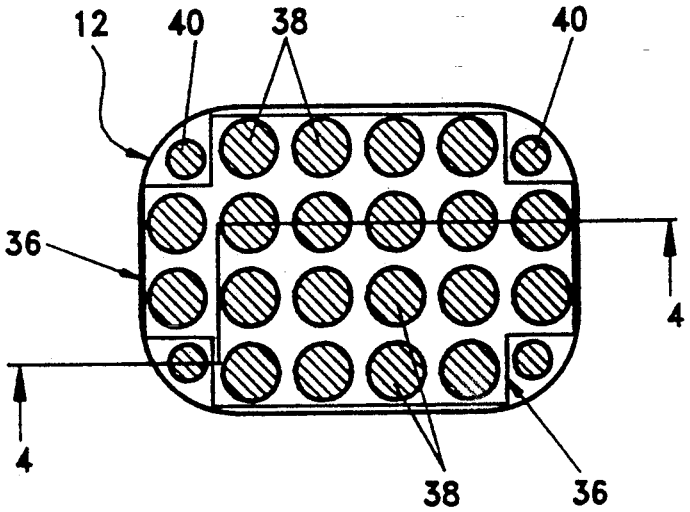
FIG. 3 is a section taken on the line 3—3 of FIG. 2.
Figure 4:
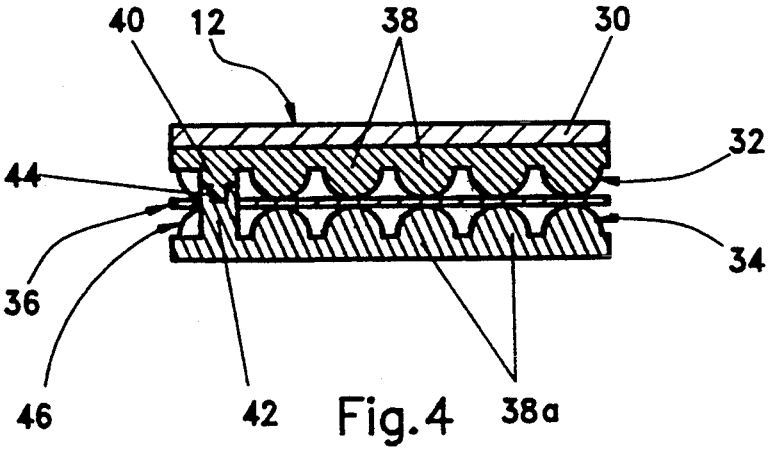
FIG. 4 is a section taken on the line 4—4 of FIG. 3.

Turning now to FIGS. 2 to 4 these show in more detail the energy return system 12 used in a shoe according to the invention. Above the system 12 is a flat upper sheet 30 of a material having a low hardness, an almost zero compression set and a low percentage rebound resilience.

Beneath the sheet 30 is an top resilient member 32 made of natural rubber and having a Shore A hardness of 50 and a bottom resilient member 34 made of butadiene rubber and having a Shore A hardness of 35. Between these two is sandwiched a 0.5 mm thick sheet 36 of ultra high molecular weight polyethylene having a molecular density as high as 6,000,000 g/mole. The sheet is available under the trade name Superlene and has the following properties:

| | |
|---|---|
| Tensile strength (DIN 53455) | 40N/mm$^2$ |
| Elongation (DIN 53455) | 350% |
| Flexural stress at 35% (DIN 53452) | 16N/mm$^2$ |
| Ball indentation hardness | |
| 30 sec value (DIN 53456 test load 365 n) | 36N/mm$^2$ |
| Shore hardness (DIN 53505) | 61.65 |
| Working temperature (DIN 53461) | +95/−200° C. |

Sheet 36 may also be made of polystyrene.

The top resilient member 32 is in the form of a flat sheet having a number of integral spaced and downwardly depending elements 38. These elements are of substantially hemispherical cross-section as is best seen in FIG. 4 and so taper in the downward direction. The resilient member 34 is similar except that it is inverted so that the elements 38*a* which are equivalent to the elements 38 now extend upwardly and their hemispherical shapes are inverted in comparison with the elements 38.

As best seen in FIG. 4 the tips or extremities of the elements 38 and 38*a* of the two members 36 and 38 are aligned with one another with the sheet 36 sandwiched in between. This has the effect of assisting in keeping them in an alignment since the cohesive friction between the tips of the elements 38 and 38*a* and the sheet 36 prevents one element sliding over the other as might be the case if the sheet 36 were omitted.

In order to ease assembly and generally hold the system 12 in one piece, at the four corners of the members 36 and 38 are provided integral pillars 40 and 42, respectively. As best seen in FIG. 4 the pillar 40 has an integral downwardly extending plug 44 which extends into a corresponding socket 46 in the upper end of the pillar 42. The receipt of the plug 44 in the socket 46 holds the two pillars, and therefore the two members 32 and 34, together.

We claim:

1. An athletic shoe in which the midsole region includes at least one energy return system comprising:

a top member made of resilient material and including a base having a plurality of integrally formed, downwardly depending first elements, the plurality of first elements each having a first tip;

a bottom member made of resilient material and including a base having a plurality of integrally formed, upwardly extending second elements, the plurality of second elements each having a second tip; and a stiff intermediate sheet positioned between, and being movable relative to, the first and second tips, said stiff sheet being sufficiently stiff and having a coefficient of friction such that the tips are prevented from sliding one over the other and thereby the tips remain in alignment upon compression of the first and second elements toward each other.

2. A shoe as claimed in claim 1 wherein the energy return system is provided only in the midsole heel region of the shoe.

3. A shoe as claimed in claim 1 wherein the top and bottom members are made of natural rubber.

4. A shoe as claimed in claim 1 wherein the top and bottom members are made of synthetic rubber.

5. A shoe as claimed in claim 1 wherein at least one of the top and bottom members is made of butadiene rubber.

6. A shoe as claimed in claim 1 wherein the material of the top member has a Shore A hardness between 30 to 80.

7. A shoe as claimed in claim 6 wherein the material of the top member has a Shore A hardness between 45 to 60.

8. A shoe as claimed in claim 1 wherein the material of the bottom member has a Shore A hardness between 30 to 70.

9. A shoe as claimed in claim 8 wherein the material of the bottom member has a Shore A hardness between 35 to 40.

10. A shoe as claimed in claim 1 wherein the intermediate sheet is made of polyethylene.

11. A shoe as claimed in claim 1 wherein the intermediate sheet is made of polystyrene.

12. A shoe as claimed in claim 1 wherein the thickness of the intermediate sheet is from 0.3 to 0.7 mm.

13. A shoe as claimed in claim 1 wherein the first and second elements have a substantially hemispherical shape.

14. A shoe as claimed in claim 1 wherein alignment elements are provided at the corners of the top and bottom members for joining one to the other.

15. A shoe as claimed in claim 1 wherein alignment elements are provided at opposite positions of the top and bottom members for joining one to the other.

16. A shoe as claimed in claim 1 wherein a sheet made o a material having a low hardness, an almost zero compression set and a low percentage rebound resilience, overlays the top member.

* * * * *

UNITED STATES PATENT AND TRADEMARK OFFICE

CERTIFICATE OF CORRECTION

PATENT NO. : 5,311,674

DATED : May 17, 1994

INVENTOR(S) : Kiartchai Santiyanont, et al.

It is certified that error appears in the above-indentified patent and that said Letters Patent is hereby corrected as shown below:

On the title page, item [76]:

In the inventors' block after "Kiartchai Santiyanont", please delete "all of 27 Pramuan Road, Silom, Bangrak, Bangkok, Thailand;"

Signed and Sealed this

First Day of November, 1994

*Attest:*

*Attesting Officer*

Bruce Lehman

BRUCE LEHMAN

*Commissioner of Patents and Trademarks*